US006875130B2

(12) United States Patent
Nishio

(10) Patent No.: US 6,875,130 B2
(45) Date of Patent: Apr. 5, 2005

(54) WOOD-TYPE GOLF CLUB HEAD

(75) Inventor: Masayoshi Nishio, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 10/345,329

(22) Filed: Jan. 16, 2003

(65) Prior Publication Data

US 2003/0171161 A1 Sep. 11, 2003

(30) Foreign Application Priority Data

Jan. 18, 2002 (JP) ..... 2002-010455

(51) Int. Cl.[7] ..... A63B 53/04
(52) U.S. Cl. ..... 473/345
(58) Field of Search ..... 473/324, 342, 473/345, 349, 350

(56) References Cited

U.S. PATENT DOCUMENTS

| | | | | | |
|---|---|---|---|---|---|
| 5,447,309 | A | * | 9/1995 | Vincent | 473/345 |
| 5,851,160 | A | * | 12/1998 | Rugge et al. | 473/349 |
| 6,048,278 | A | * | 4/2000 | Meyer et al. | 473/345 |
| 6,425,832 | B2 | * | 7/2002 | Cackett et al. | 473/345 |
| 6,599,202 | B2 | * | 7/2003 | Miyamoto | 473/289 |
| 6,607,452 | B2 | * | 8/2003 | Helmstetter et al. | 473/345 |
| 2001/0051548 | A1 | * | 12/2001 | Iwata et al. | 473/329 |
| 2002/0037774 | A1 | * | 3/2002 | Miyamoto | 473/287 |
| 2002/0183137 | A1 | * | 12/2002 | Nishio | 473/345 |
| 2003/0171161 | A1 | * | 9/2003 | Nishio | 473/345 |

* cited by examiner

*Primary Examiner*—Raleigh W. Chiu
(74) *Attorney, Agent, or Firm*—Birch, Stewart, Kolasch & Birch, LLP

(57) ABSTRACT

A wood-type golf club head which has a head volume of not less than 320 cc, a gravity point distance (C) in a range of from 25 to 35 mm, and a heel area width (A) in a range of from 30 to 52% of a clubhead width (B).

7 Claims, 4 Drawing Sheets

WOOD-TYPE GOLF CLUB HEAD

This nonprovisional application claims priority under 35 U.S.C. § 119(a) on Patent Application No. 2002-10455 filed in JAPAN on Jan. 18, 2002, which is herein incorporated by reference.

BACKGROUND OF THE INVENTION

The present invention relates to a wood-type golf club head, more particularly to an improved configuration for a large-sized club head being capable of improving return motion of the head at the time of hitting a ball.

In recent years, wood-type club heads for drivers and the like are increased in the volume, while preventing the weight from increasing, and club heads having a volume of more than 320 cc are widely used. In such a golf club, as the club shaft is relatively long, it is difficult to control the motion of the club head at the time of hitting a ball. On the other hand, the distance of the gravity point of the club head from the axis of the club shaft basically increases as the size of the club head becomes large. As a result, it becomes difficult to return a club head to an expected position as shown in FIG. 7*b* at the time of hitting a ball. There is a tendency for a club head not to return to the expected position as shown in FIG. 7*a*, and the struck ball is liable to train off for example on the right in case of a right-handed golfer.

Generally speaking, it is possible to adjust the positions of the gravity point, sweet spot and the like of the club head by changing the distribution of the wall thickness of the club head. However, in a large-sized club head, which has a very large head volume of over 400 cc in particular, the wall thickness reaches its limit to reduce the weight of the club head. Accordingly, it is very difficult to shift the minimum wall thickness to obtain a desired thickness distribution. Further, it is also difficult to fix a separate weight to the inside of the club head because the wall is very thin. Thus, it is difficult to design the optimum position of the gravity point.

SUMMARY OF THE INVENTION

It is therefore, an object of the present invention to provide a wood-type golf club head, in which the design freedom is increased with respect to the gravity point in particular, and the return motion of the head at the time of hitting a ball is improved.

According to the present invention, a wood-type golf club head has a head volume of not less than 320 cc, a gravity point distance in a range of from 25 to 35 mm, and a heel area width in a range of from 30 to 52% of a clubhead width, wherein the head volume, gravity point distance, heel area width and clubhead width are parameters of the club head defined below. By setting the parameters as above, the return motion of the club head can be improved as shown in FIG. 7*b*.

DESCRIPTION OF THE PREFERRED EMBODIMENT(S)

Figure 1:
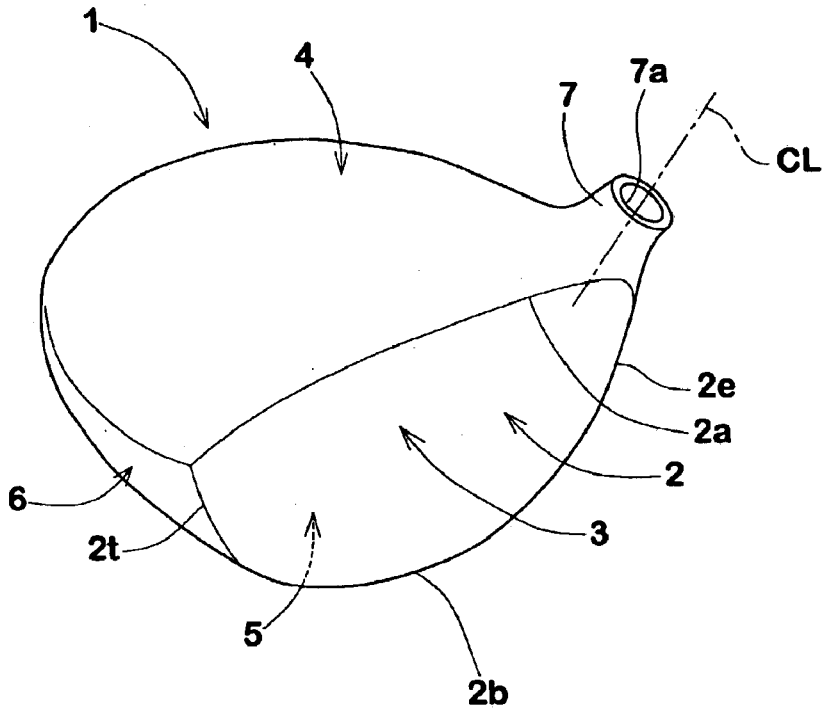
FIG. 1 is a perspective view of a club head according to the present invention.
Figure 2:
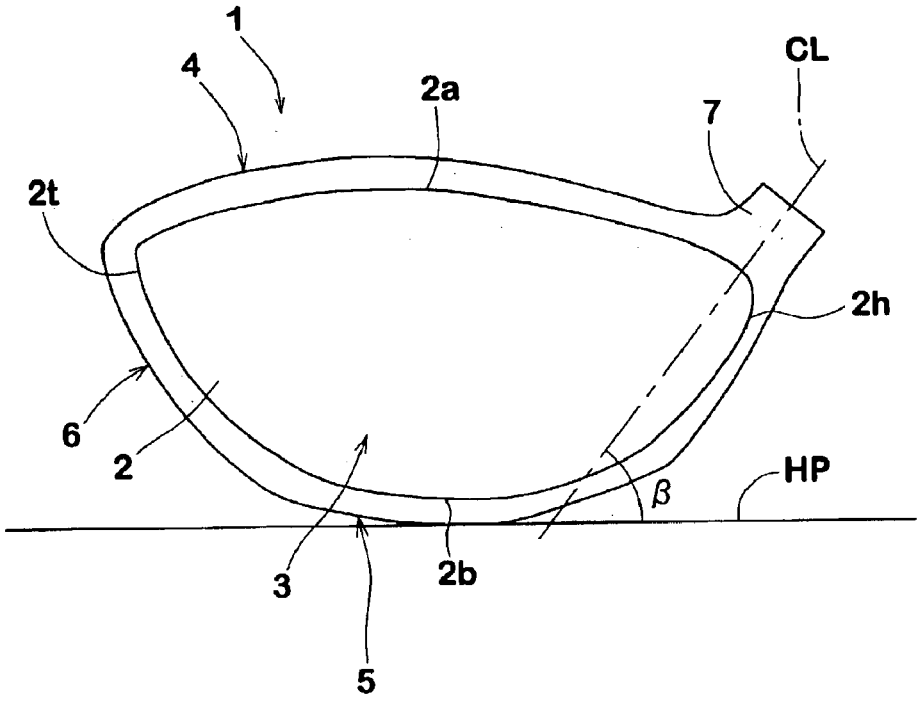
FIG. 2 is a front view thereof.
Figure 3:
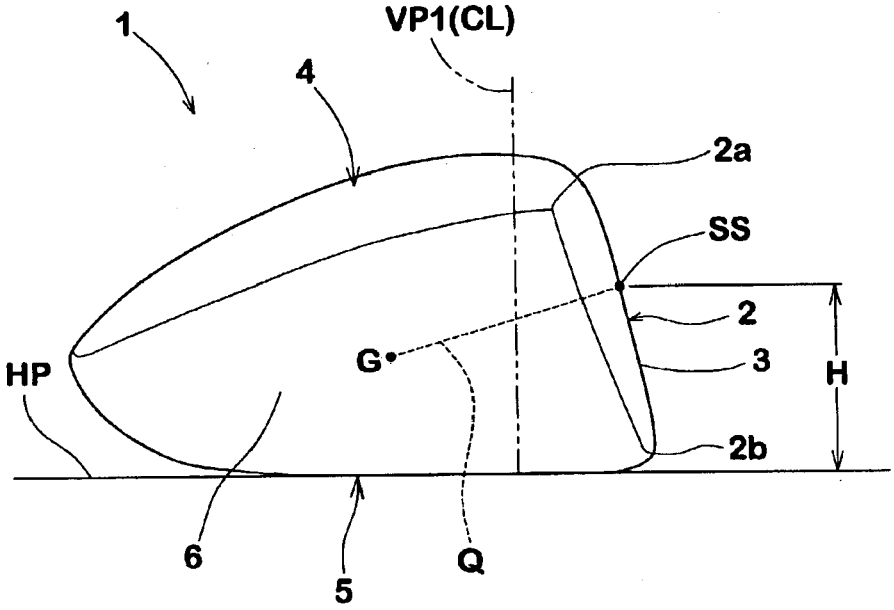
FIG. 3 is a side view thereof.
Figure 4:
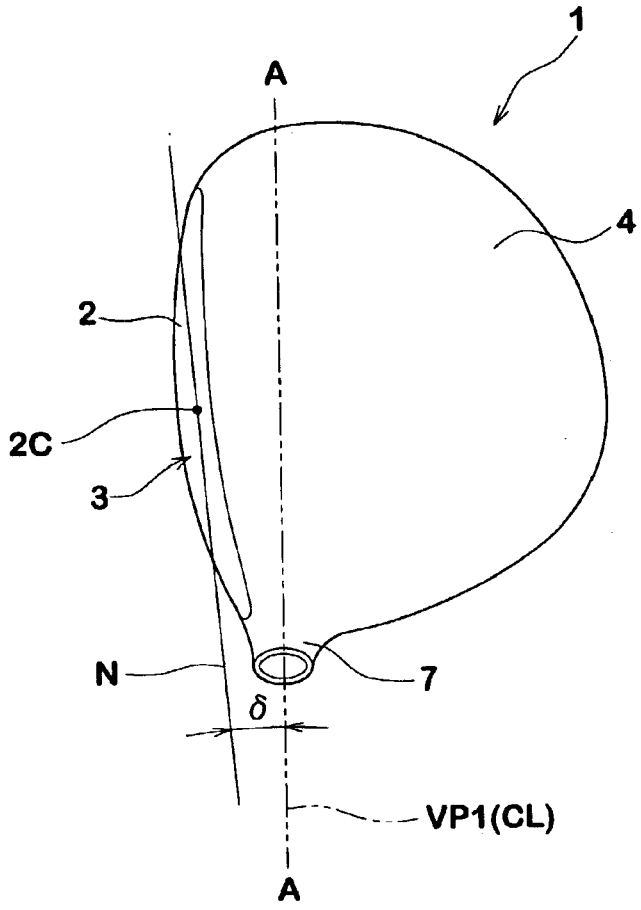
FIG. 4 is a top view thereof.

Embodiments of the present invention will now be described in detail in conjunction with the accompanying drawings.

In the drawings, golf club head 1 according to the present invention is a hollow wood-type golf club head comprising a face portion 3 of which front face defines a clubface 2 for striking a ball, a crown portion 4 intersecting the clubface 2 at the upper edge 2*a* thereof, a sole portion 5 intersecting the clubface 2 at the lower edge 2*b* thereof, a sidewall portion 6 between the crown portion 4 and sole portion 5 which extends from a toe-side edge 2*t* to a heel-side edge 2*e* of the clubface 2 through the back face of the club head, and a neck portion 7 to be attached to an end of a club shaft (not shown).

Figure 5:
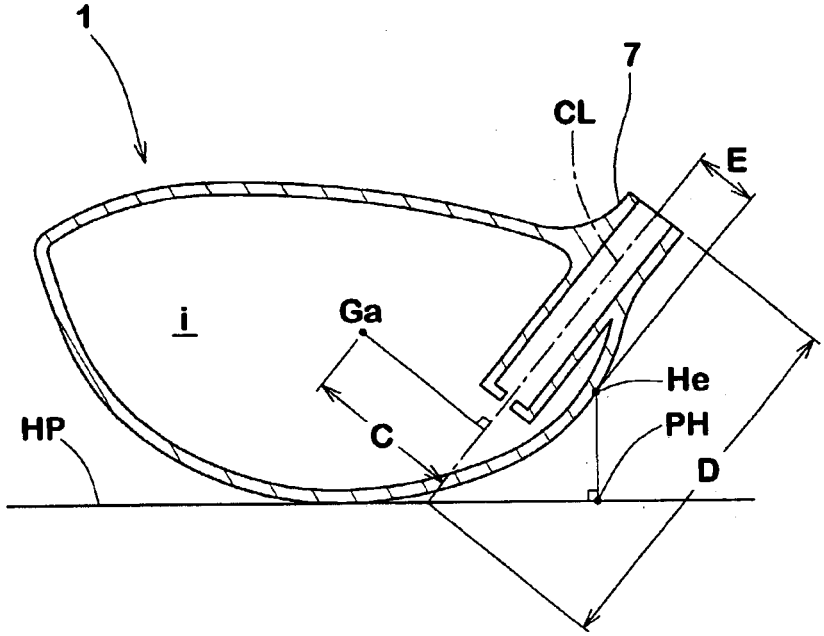
FIG. 5 is a cross sectional view taken along a vertical plane VP1.

The neck portion 7 is provided with a shaft inserting hole 7*a* having an opening for the club shaft at the upper end thereof. The neck portion 7 comprises an inner tubular part extended into the cavity (i). In this example, as shown in FIG. 5, the tubular part terminates in the cavity (i). But, it is also possible to extend the tubular part to the inner surface of the sole portion 5 to secure the lower end thereto. In any case, the axis (CL) of the shaft inserting hole 7*a* can be used instead of the axis of the inserted club shaft when setting up the clubhead alone in the undermentioned measuring state.

Definitions

"Measuring state of the club head"

The club head 1 is put on a horizontal plane (HP) such that the shaft axis (CL) of the shaft inserting hole 7*a* inclines within a vertical plane VP1 at the predetermined lie angle β, and an angle between the vertical plane VP1 and a horizontal tangential line (N) to the centroid 2*c* of the clubface 2 becomes the predetermined face angle δ.

"Horizontal projective profile line"

Figure 6:
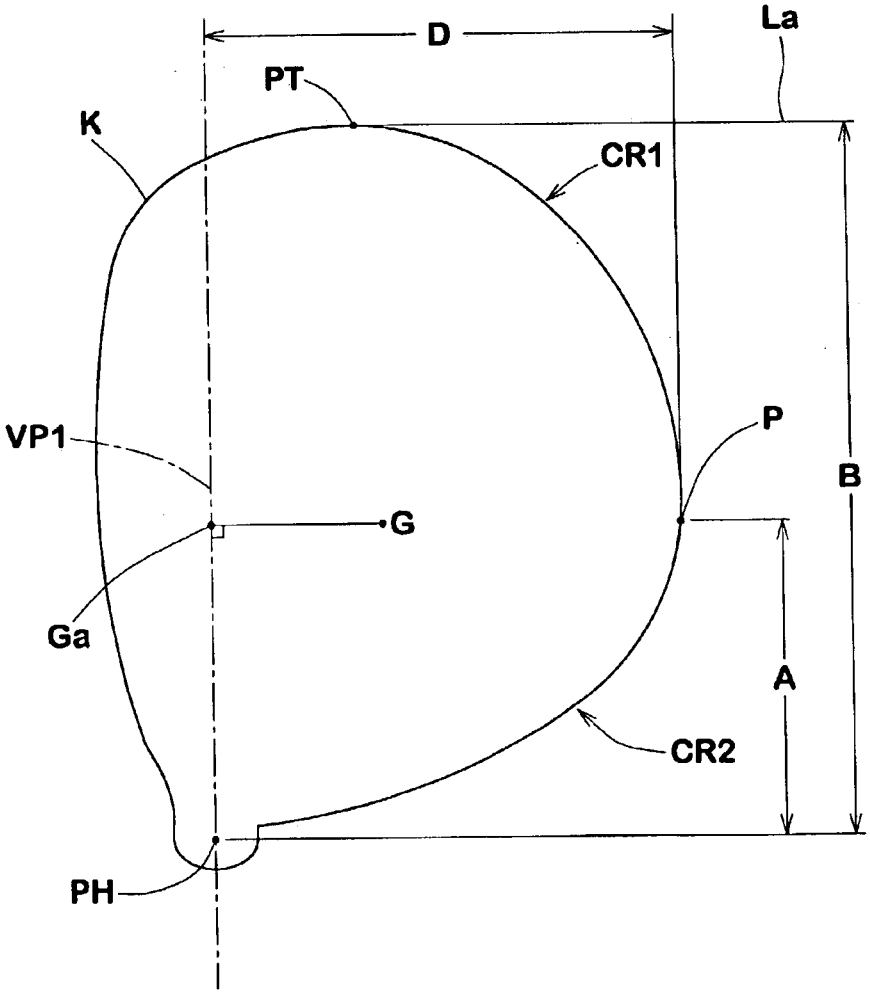
FIG. 6 shows a profile line of the club head projected on a horizontal plane.
Figure 7A:
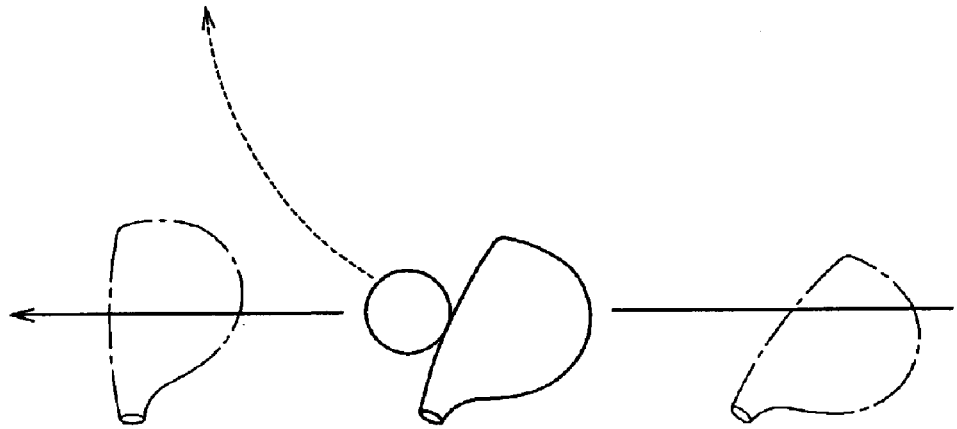
FIG. 7*a* shows a state of a club head of which return motion is insufficient and thus there is a slice tendency.
Figure 7B:
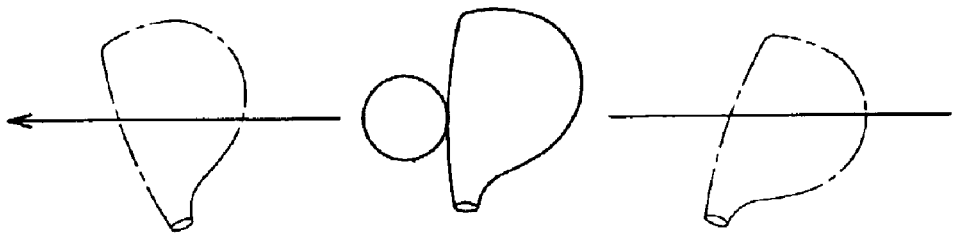
FIG. 7*b* shows a state of a club head of which return motion is sufficient, and the directionally stability is good.

The profile line (K) of the club head 1 projected on the horizontal plane (HP) under the measuring state. see FIG. 6

"Toe point"

An extreme end (PT) of the horizontal projective profile line (K), on the toe side thereof, in a direction parallel to the vertical plane VP1.

"Heel point"

A point (PH) on the same plane as of the profile line (K) (namely, the horizontal plane HP) which point is, as shown in FIG. 5, a projection of a heel end (He), wherein the heel end (He) is a point on the vertical plane VP1 being farthest from the shaft axis (CL) in a direction at a right angle to the shaft axis (CL) towards the heel.

"Rear end point"

A point (P) on the projective profile line (K) being farthest from the vertical plane VP1 towards the backside of the club head.

"Clubhead width"

The distance (B) between the heel point (PH) and toe point (PT) measured in parallel with the vertical plane VP1.

"Heel area width"

The distance (A) between the heel point (PH) and rear end point (P) measured in parallel with the vertical plane VP1.

"Gravity point distance"

The distance (C) of a point (Ga) on the vertical plane VP1 from the shaft axis (CL) which point is, as shown in FIG. 5, a projection of the gravity point (G) of the club head on the vertical plane VP1.

"Sweet spot"

A point (SS) of intersection between the clubface 2 and a normal line (Q) to the clubface 2 drawn from the gravity point (G).

"Sweet spot height"

A height (H) of the sweet spot (SS) from the horizontal plane (HP). .

"Head volume"

The apparent volume of the club head including the shaft inserting hole, cavity (i) and the like.

In FIGS. 1–6 showing an embodiment of the present invention, the club head 1 is for number one (#1) driver.

In order to give the user a sense of assurance and an idea of easy handling and to make it possible to increase the moment of inertia, the volume of the club head 1 is set to be more than 320 cc, preferably more than 350 cc, more preferably more than 360 cc, still more preferably more than 380 cc, yet still more preferably more than 400 cc. However, in order to avoid an excessive weight increase and a decrease in the durability under the limited weight, it is preferable that the head volume is limited to less than 550 cc, usually less than 500 cc.

The club head 1 can be made of various metal materials such as aluminum alloys, pure titanium, titanium alloys and stainless, and fiber reinforced plastics. Especially, titanium alloys having a high specific tensile strength are preferably used. In this embodiment, therefore, major part of the club head 1 is made of an alpha-beta-type titanium alloy (Ti-6Al-4V), using lost-wax precision casting, and the rest, for example a forged face plate, are welded to the major part. Thus, the club head 1 has a shell body which is formed by the face portion 3, crown portion 4, sole portion 5 and sidewall portion 6, defining a closed cavity (i) therein. It is possible to leave the cavity (i) void, but it is also possible to provide a filler such as foamed plastic, foamed rubber and elastomers.

The club head has the following specific configuration.

Firstly, in order that it becomes possible to optimize the gravity point distance (C), the percentage of the heel area width (A) to the clubhead width (B) is set to be not less than 30%, preferably not less than 35%, more preferably not less than 40%, but not more than 52%, preferably not more than 50%, more preferably not more than 45%. If the percentage is more than 52%, the gravity point distance becomes increased as in the conventional club head, and the return motion of the club head tends to become insufficient. If the percentage is less than 30%, there is a tendency for the club head to display over return motion and to hook a ball.

The projective profile line (K) is such that each of a toe-side part CR1 defined as extending from the rear end point (P) to the toe point (PT) and a heel-side part CR2 defined as extending from the rear end point (P) to a point near the heel point (PH) is a convex curved line as shown in FIG. 6, which may be a multi-radius curve, single-radius curve, elliptic curve or the like. From the toe point (PT) to the point near the heel point (PH), there is no inflection point.

The gravity point distance (C) is set in a range of from 25 to 35 mm, preferably 30 to 35 mm. If the gravity point distance (C) is more than 35 mm, the return motion of the club head tends to become insufficient. If the gravity point distance (C) is less than 25 mm, the club head tends to decrease its moment of inertia, and variation in the direction of the struck ball becomes increased depending on the hit position.

In order to shift the gravity point (G) towards the heel, the heel portion bulges out, forming a gap between the above-mentioned tubular part of the neck portion 7 and the inner face of the heel portion as shown in FIG. 5. The distance E of the heel end (He) of which definition is given above, is set in a range of from 8 to 16 mm, preferably 8 to 10 mm from the shaft axis (CL).

Further, in order to decrease the weight of the club head in the neck portion 7 and thereby to facilitate the sweet spot height (H) decreasing, the distance (D) measured along the shaft axis (CL) from the upper end of the neck portion 7 to the horizontal plane (HP) as shown in FIG. 5, is set to be not more than 70 mm, preferably not more than 60 mm, more preferably in a range of from 55 to 75 mm, still more preferably in a range of from 55 to 65 mm.

The sweet spot height (H) is set to be less than 40 mm, preferably less than 37 mm, but not less than 25 mm, preferably not less than 28 mm. If the sweet spot height (H) is more than 40 mm, there is a tendency for the struck ball to become a low ballistic course and the carry is decreased. If the sweet spot height (H) is less than 25 mm, the ballistic course is liable to become too high.

Under the measuring state, a moment of inertia (F) of the club head 1 around a vertical axis passing through the gravity point (G) is set in a range of from 2800 to 5000, preferably 2900 to 4800, more preferably 3000 to 4500 g·sq.cm. If the moment of inertia (F) is less than 2800 g·sq.cm, when hitting a ball off the sweet spot (SS), sidespin of the struck ball, which is caused by the gear effect and may correct the ballistic course, becomes insufficient and as a result, the directional stability of the club head deteriorates. If the moment of inertia (F) is more than 5000 g·sq.cm, it is difficult to make such a head, namely, the upper limit is a limit in manufacturing.

In this example, the inside of the club head is not provided with a separate weight to adjust the above-mentioned parameters. They are mainly achieved by the above-mentioned configuration. But it is of course possible to vary the thickness distribution of the clubhead wall such as in the sole portion 5.

Comparison test

Wood-type golf club heads having the basic configuration for right-handed shown in FIG. 1 and specifications given in Table 1 were made. The club head was principally formed of a casting of Ti-6Al-4V. The loft angle and face angle were 11 degrees and 3.5 degrees, respectively. The club heads were attached to 46-inch carbon shafts to make golf clubs (number one driver).

Golf balls were hit by five golfers (right-handed) using the above golf clubs, and in order to evaluate return motion of the club head, deviation of the actual trajectory of the struck ball from the target was measured. The results are indicted in meter in Table 1, wherein "–" minus sign means that the deviation is left side and accordingly no sign or plus sign means right side.

TABLE 1

| Club Head | | Ex. 1 | Ex. 2 | Ref. 1 | Ex. 3 | Ex. 4 | Ref. 2 |
|---|---|---|---|---|---|---|---|
| Head volume | (cc) | 380 | 380 | 380 | 450 | 450 | 450 |
| Heel area width (A)/Clubhead width (B) | (%) | 45 | 52 | 55 | 42 | 52 | 56 |
| Gravity point distance (C) | (mm) | 32.2 | 34.5 | 37 | 33.7 | 34.8 | 39.4 |
| Sweet spot height (H) | (mm) | 29.5 | 29.7 | 30.5 | 31.3 | 32 | 32.4 |
| Moment of inertia | (g · sq.cm) | 3510 | 3535 | 3560 | 4350 | 4375 | 4383 |
| Distance (E) | (mm) | 10 | 10 | 6.2 | 15 | 13.5 | 6.2 |
| Distance (D) | (mm) | 62 | 62 | 62 | 65 | 65 | 65 |
| Deviation | (m) | | | | | | |
| testers * A (HC. 5) | | −1 | −0.5 | −1.6 | −0.7 | 0.2 | 2.3 |
| B (HC. 8) | | −0.5 | 0.5 | 2.1 | −0.6 | 1.2 | 3.4 |
| C (HC. 12) | | −2.2 | −0.2 | 3.9 | −1.7 | 0.8 | 5.1 |
| D (HC. 15) | | −3.8 | −0.8 | 4.4 | −2.5 | 1.3 | 5.9 |
| E (HC. 18) | | −4.4 | −2.8 | 4.2 | −3.9 | −0.8 | 7.2 |
| Average | | −2.4 | −0.72 | 3.24 | −1.9 | 0.54 | 4.78 |

* The number in parentheses shows the tester's handicap.

From the test results, it was confirmed that, in comparison with the reference heads, Example heads could be decreased in the magnitude of the deviation, and the directions of the deviations were almost left side. This means that the return motion of the club head was improved, and the holding of the ball was improved.

As described above, according to the present invention, the club head has a very large volume of not less than 320 cc and the rear end point is shifted towards the heel and the gravity point distance is decreased in comparison with the conventional heads. Therefore, the return motion of the club head can be improved and as a result the holding of a golf ball can be improved. Accordingly, it become possible to make a draw shot easily for the average golfers to increase the carry. Further, as the gravity point and the moment of inertia around the vertical axis are limited as above, the directional stability of the hit ball can be improved. As the position of the heel end is limited as above, it becomes possible to more effectively shift the gravity point towards the heel.

The present invention can be suitably applied to a large-sized wood-type golf club head, but it is also possible to apply the invention to club heads for fairway wood and the like.

What is claimed is:

1. A wood-type golf club head having a head volume of not less than 320 cc, a gravity point distance in a range of from 25 to 35 mm, a sweet spot height in a range of from 28 to 40 mm, and a heel area width in a range of from 40 to 45% of a club head width, wherein under a measuring state of the club head set on a horizontal plane such that a shaft axis inclines within a vertical plane at its lie angle and an angle between the vertical plane and a horizontal tangential line to the centroid of a clubface forms its face angle, the gravity point distance is defined as the distance of a point which is a projection of the gravity point of the club head on the vertical plane, measured from the shaft axis, the sweet spot height is a height from the horizontal plane of a sweet spot which is a point of intersection between the clubface and a line normal to the clubface drawn from the gravity point, the heel area width is defined as the distance between a heel point and a rear end point measured in parallel with the vertical plane, the heel point is a projection of a heel end on the horizontal plane, the heel end is a point on the vertical plane which is farthest from the shaft axis in a direction at a right angle to the shaft axis towards the heel, the rear end point is a point on a projective profile line which is farthest from the vertical plane towards the backside of the club head, the horizontal projective profile line is the profile line of the club head projected on the horizontal plane, the club head width is the distance between the heel point and a toe point measured in parallel with the vertical plane, and the toe point is an extreme end of the horizontal projective profile line, on the toe side thereof, in a direction parallel to the vertical plane.

2. A wood-type golf club head according to claim 1, wherein a sweet spot height is in a range of from 28 to 37 mm.

3. A wood-type golf club head according to claim 1, wherein a moment of inertia of the club head around a vertical axis passing through the gravity point of the club head is in a range of from 2800 to 5000 g·sq.cm.

4. A wood-type golf club head according to claim 1, wherein a heel end of the club head is at a distance E of from 8 to 16 mm from a club shaft axis.

5. A wood-type golf club head according to claim 1, wherein the head volume is more than 350 cc and less than 550 cc.

6. A wood-type golf club head according to claim 1, wherein the gravity point distance is in a range of from 30 to 35 mm.

7. A wood-type golf club head having a head volume of not less than 320 cc, a gravity point distance in a range of from 25 to 35 mm, and a heel area width in a range of from 30 to 50% of a club head width, wherein under a measuring state of the club head set on a horizontal plane such that a shaft axis inclines within a vertical plane at its lie angle and an angle between the vertical plane and a horizontal tangential line to the centroid of a clubface forms its face angle, the gravity point distance is defined as the distance of a point which is a projection of the gravity point of the club head on the vertical plane, measured from the shaft axis, the sweet spot height is a height from the horizontal plane of a sweet spot which is a point of intersection between the clubface and a line normal to the clubface drawn from the gravity point, the heel area width is defined as the distance between a heel point and a rear end point measured in parallel with the vertical plane, the heel point is a projection of a heel end on the horizontal plane, the heel end is a point on the vertical plane which is farthest from the shaft axis in a direction at a right angle to the shaft axis towards the heel, the rear end point is a point on a projective profile line which is farthest from the vertical plane towards the backside of the club head, the horizontal projective profile line is the profile line of the club head projected on the horizontal plane, the club head width is the distance between the heel point and a toe point measured in parallel with the vertical plane, and the toe point is an extreme end of the horizontal projective profile line, on the toe side thereof, in a direction parallel to the vertical plane.

* * * * *